US005282278A

United States Patent [19]

Miner

[11] Patent Number: 5,282,278

[45] Date of Patent: Feb. 1, 1994

[54] EMBLEM BEARING CAP

[75] Inventor: Jon S. Miner, New Brighton, Minn.

[73] Assignee: Internatural Designs, Inc., Minneapolis, Minn.

[21] Appl. No.: 96,546

[22] Filed: Jul. 23, 1993

[51] Int. Cl.[5] ..... A42B 1/04

[52] U.S. Cl. ..... 2/195.1; 2/181.4; 2/209.13; 40/329

[58] Field of Search ..... 2/181, 181.4, 181.6, 2/181.8, 182.1, 182.2, 182.3, 182.5, 185 R, 195, 192, 199, 244, 246, DIG. 11; 40/299, 329, 330, 665

[56] References Cited

U.S. PATENT DOCUMENTS

| | | | |
|---|---|---|---|
| Re. 33,430 | 11/1990 | Nunnery | 2/181 |
| 1,667,162 | 4/1928 | Kuhns | 40/329 |
| 3,673,611 | 7/1972 | Cain | 2/192 |
| 4,198,772 | 4/1980 | Furutu | 40/665 |
| 4,856,214 | 8/1989 | Machen | 40/665 |
| 5,003,640 | 4/1991 | Pizzacar | 2/199 |

*Primary Examiner*—Clifford D. Crowder
*Assistant Examiner*—Diana L. Biefeld
*Attorney, Agent, or Firm*—Palmatier, Sjoquist & Helget

[57] ABSTRACT

An emblem bearing cap attachment has a substantially planar, relatively stiff body defining a forward surface and a rearward surface. A primary crease extends centrally across the planar body defining an upper facing panel and a lower backing panel. The primary crease facilitates folding of the body about and capturing the band of a baseball style cap to position the rearward surface of the facing panel in confronting relationship with the inside surface of the crown rearward portion whereat are fastening means to secure the backing panel to the cap. The facing panel allows the display of emblems or other indicia thereon whether the facing panel is folded upwardly or downwardly.

22 Claims, 2 Drawing Sheets

EMBLEM BEARING CAP

BACKGROUND OF THE INVENTION

This invention relates to baseball style caps, and more particularly to a cap with an emblem bearing cap attachment.

For as long as there has been baseball, there have been baseball caps. People wear their caps for all occasions. They are generally made of a fabric or woven material having a hemispherical crown. The crown may also be cylindrical with a flat top. Inside the crown at the lower periphery is located a rim or band of reinforced material for securing the cap to the head. At the forward lower periphery portion of the crown is located a stiff visor or bill to assist in keeping the sun out of the eyes of the wearer. Also on the outside of the forward crown portion, indicia or advertising is most common. This construction is universal with respect to all known baseball style caps.

At the rearward portion of the crown, the baseball caps begin to somewhat deviate. There are customized caps which have a continuous rim or band around the lower periphery of the crown for exact size fitting for a specific head size. Baseball caps are also made which are adjustable. At the rearward portion of the crown, they have a semicircular opening whereat the band or rim stops and a band sizing adjustment strap begins. Both these styles are always bare of indicia or the like at the rearward crown portion.

Recently it has become a fad for kids and young adults to wear their baseball caps with the visor or bill directed rearwardly. Wearing the cap in this orientation de-emphasizes the advertising or indicia on the crown forward portion which is undesirable by merchants. Furthermore, the band does not typically absorb perspiration at the forehead.

There is a need for an emblem bearing cap attachment which will secure about the band at the lower periphery of the rearward crown portion to completely cover the semicircular opening and permit the display of emblems or other indicia at the rear of the cap.

SUMMARY OF THE INVENTION

An emblem bearing cap attachment has a substantially planar, relatively stiff body defining a forward surface and a rearward surface. A primary crease extends centrally across the planar body defining an upper facing panel and a lower backing panel. The primary crease facilitates folding of the body about and capturing the band of a baseball style cap to position the rearward surface of the facing panel in confronting relationship with the inside surface of the crown rearward portion whereat are fastening means to secure the backing panel to the cap. The facing panel allows the display of emblems or other indicia thereon whether the facing panel is folded upwardly or downwardly.

A principal object and advantage of the present invention is that the emblem bearing cap attachment makes the cap aesthetically more appealing and appearing.

Another object and advantage of the present invention is that the emblem bearing cap attachment permits the additional display on the cap of a name, emblem, crest, advertisement, trademark, team name, number or other indicia by way of imprinting or embroidery.

Another object and advantage of the present invention is that the cap attachment is made of soft, pliable, moisture absorbent material which fits against the forehead and covers the band to both increase comfort and absorb perspiration.

Another object and advantage of the present invention is that it gives the cap the further appearance of being custom made.

Another object and advantage of the present invention is that the cap attachment is simple and inexpensive to manufacture in mass quantities with precise and well defined shapes for advertising.

Another object and advantage of the present invention is that the cap attachment is easy to install and may be used for years.

Other objects and advantages will become readily apparent upon review of the following figures, specification, and appended claims.

BRIEF DESCRIPTION OF THE DRAWINGS

FIG. 7 is a side elevational view of the cap attachment secured to a cap.

DETAILED DESCRIPTION

Figure 1:
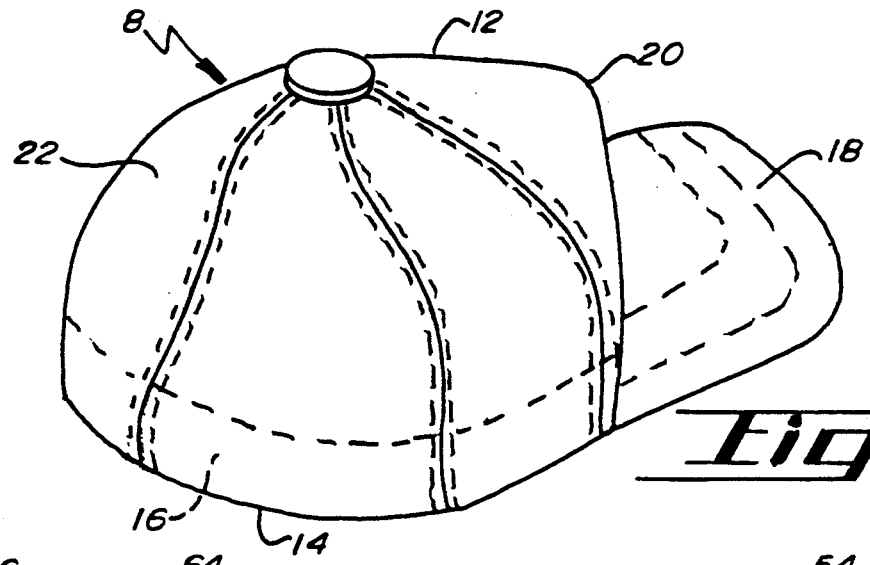
FIG. 1 is a partially broken away rear perspective view of an adjustable baseball style cap.
Figure 2:
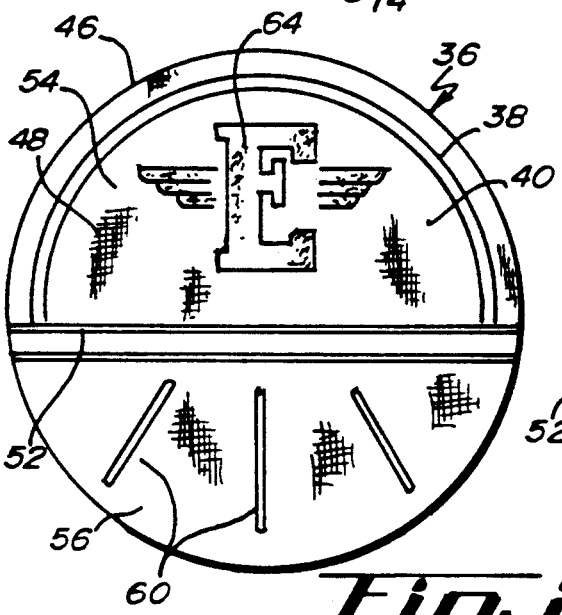
FIG. 2 is a front elevational view of the emblem bearing cap attachment of the present invention.
Figure 3:
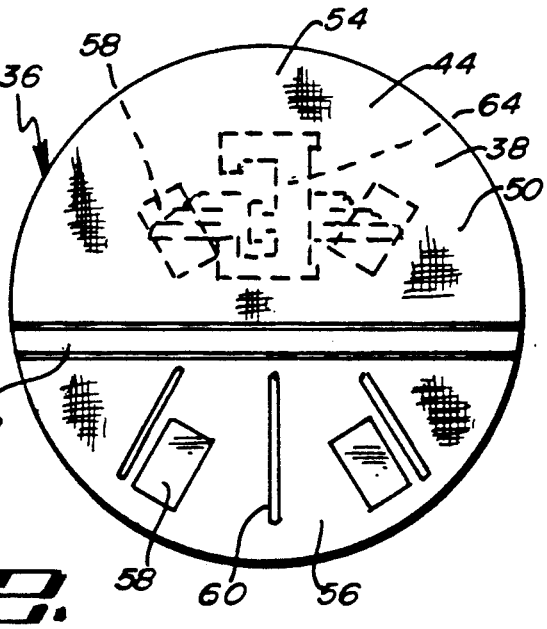
FIG. 3 is a rear elevational view of the cap attachment.
Figure 4:
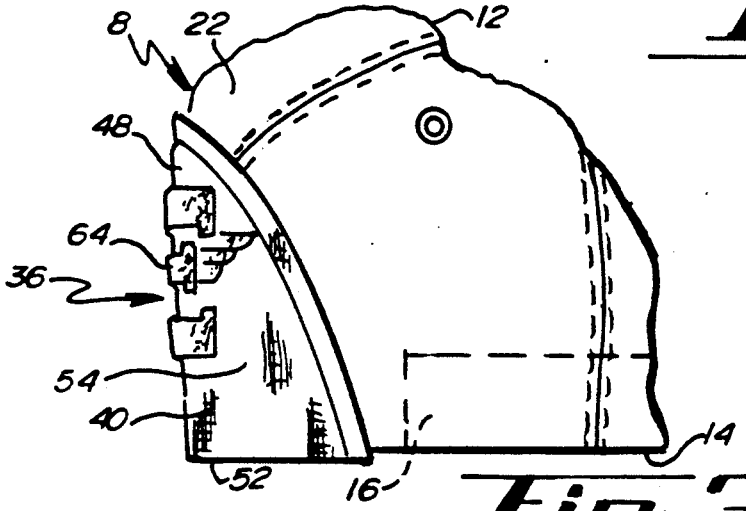
FIG. 4 is a perspective view of the cap in phantom outline supporting the emblem bearing cap attachment.
Figure 4:
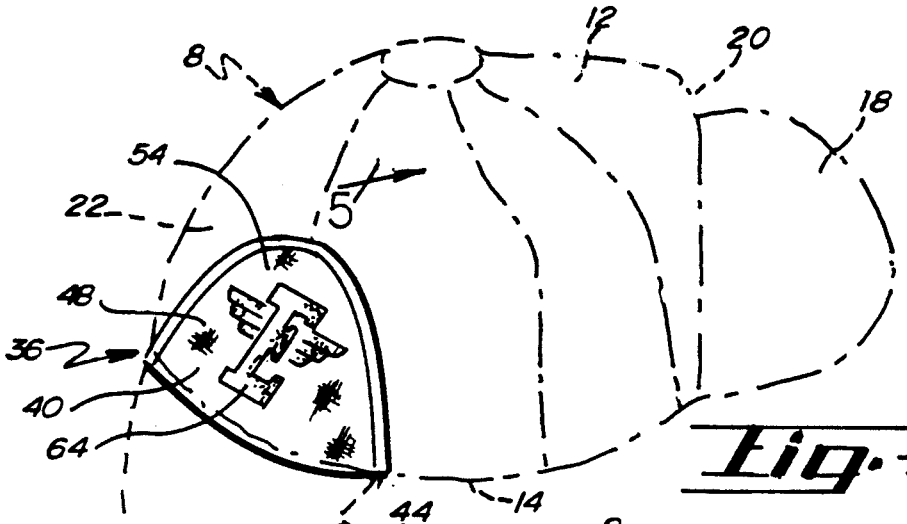
Figure 5:
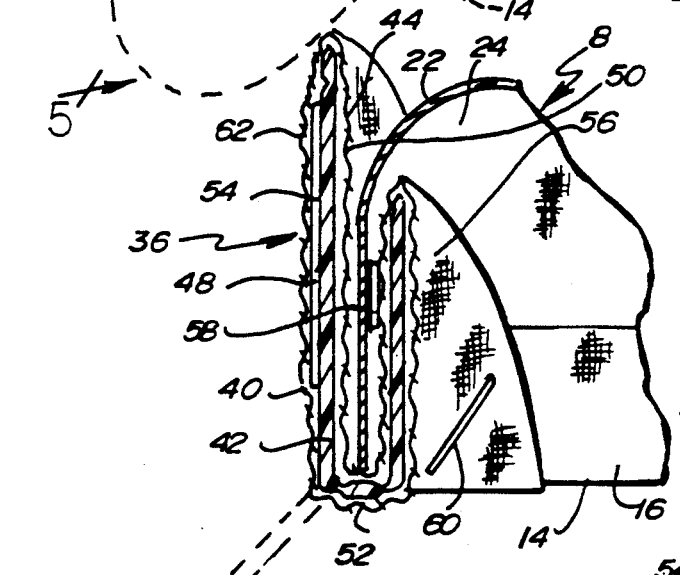
FIG. 5 is a cross sectional view taken through lines 5—5 of FIG. 4.
Figure 6:
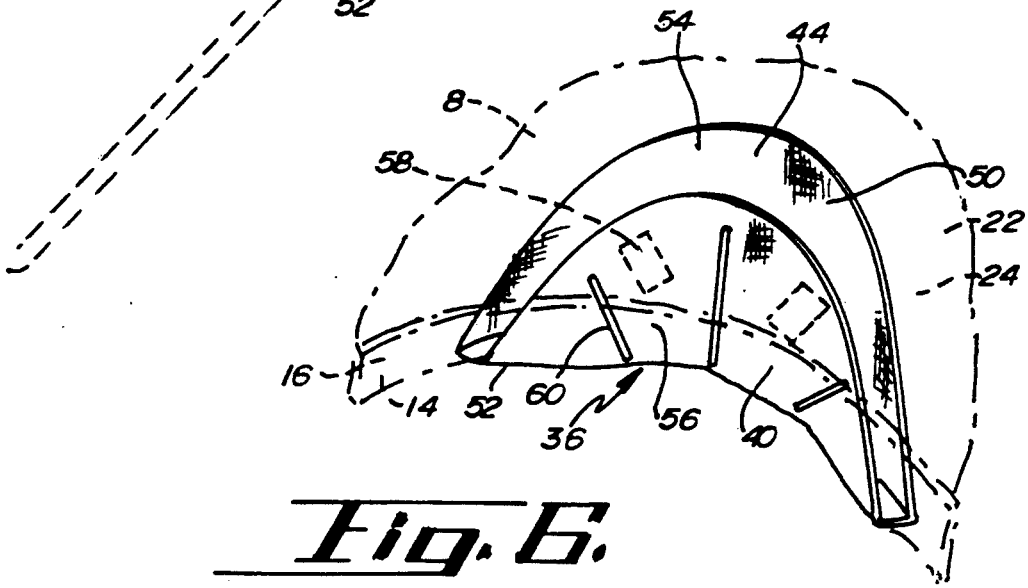
FIG. 6 is a perspective view taken from inside the cap looking rearwardly showing the cap attachment secured to the cap which is shown in phantom outline.

Referring to FIG. 1, a baseball style cap 10 generally has a hemispherical crown 12 made of pliable fabric or cloth. The crown 12 may also take the shape of a cylinder with a flat top. The crown 12 has a lower periphery 14 where at a padded or reinforced rim or band 16 extends around the lower periphery 14 of the crown 12. A stiff visor or bill 18 extends forwardly from the crown forward portion 20 at the lower periphery 14. The crown rearward portion 22 is typically bare.

Referring to FIGS. 2 through 7, the emblem bearing cap attachment 36 may be appreciated. The cap attachment 36 has a planar body 38 which may have a circular profile but may take other shapes on the upper portions of the body 38 for aesthetic purposes. Planar body 38 has a face 40 made of a woven fabric, such as absorbing cotton, which is secured to a liner or support material 42 which is relatively stiff, such as cross-linked, closed-cell polyethylene. Optionally, a backing material 44, such as cotton, may be secured to the support material 42 to provide a finished appearance. The face material 40, polyethylene liner 42, and backing material 44 suitably are adhesively laminated together and thereafter may be die cut to a particular shape, such as by stamping, to achieve any of a variety of shapes including circular, crested, scalloped or combed. The adhesive lamination method of securing the three materials 40, 42 and 44 together is ideal for mass manufacturing as the cap attachment 36 may have its shape maintained mechanically in its assembly. This process eliminates the need for a border 46 material and further eliminates sagging or wrinkling of the cap attachment 36.

The cap attachment 36 has a forward surface 48 and a rearward surface 50. Extending centrally across the planar body 38 is a primary crease 52 which suitably is horizontal and facilitates a folding of the planar body 38. The primary crease 52 defines an upper facing panel 54 and a lower backing panel 56. At the rearward surface 50 of the backing panel 56 spaced from the primary crease 52 is located fastening means 58. Fastening means 58 suitably may be stitching, hook and loop material (VELCRO), snaps, double-sided adhesive tapes, buttons or hooks and eyes or loops. The fastening means 58 may also be on the rear surface 50 of the facing panel 54. Also in the backing panel 56 are optionally located secondary creases 60 which radiate outwardly from the central regions of the planar body 38. The secondary creases 60 facilitate arcuate bending of the backing panel 50 to conform to the circular shape of the lower periphery 14 of the cap 10, the plastic straps 30 and the human head.

On the forward surface 48 of the facing panel 54 may be located indicia 64 which may be a name, emblem, crest, advertisement, trademark, team name, number or other matter whether printed or embroidered. Indicia 64 may also be placed on the rearward surface 50 of the facing panels 54 if fastening means 58 are omitted therefrom. The relatively stiff polyethylene support liner 42 may also have a raised or relief area 62 which gives the indicia 64 an embossed look.

The use of the cap attachment 36 may now be appreciated. The individual takes his cap 10 and the planar body 38 and begins to fold the body 38 at the primary crease 52 which is positioned to abut against the bottom of the plastic straps 30. As the backing panel 56 is swung toward the facing panel 56 on the inside 24 of the cap 10, the respective fastening means 58 are engaged inside and outside of the rearward crown portion 22. Now the cap attachment 36 is secured to the cap which now may comfortably be worn in a forward or rearward orientation. The secondary creases 60 allow the backing panel 56 to arcuately bend for proper fitting. The facing panel 54 may be positioned upwardly to display indicia 64 on its forward surface 48 or downwardly to display indicia 64 on its rearward surface 50 suitably when no fastening means are located on rearward surface 50 of the facing panel.

The present invention may be embodied in other specific forms without departing from the spirit of essential attributes thereof; therefore, the illustrated embodiment should be considered in all respects as illustrative and not restrictive, reference being made to the appended claims rather than to the foregoing description to indicate the scope of the invention.

I claim:

1. A baseball style cap with an emblem bearing cap attachment, the cap having a crown with an inside for fitting on a human head with a lower periphery, a forward portion with a forwardly directed stiff visor extending from the lower periphery, a rearward portion and a band extending around the inside of the lower periphery of the crown, the emblem bearing cap attachment comprising:

(a) a substantial planar body having a fabric face material and a relatively stiff support material secured together defining a forward surface and a rearward surface, a primary crease extending centrally across the planar body defining a facing panel for display of indicia and a backing panel respectively above and below the crease, the primary crease facilitating a folding of the body about the rearward portion of the band to position the rearward surface of the backing panel in confronting relationship with the inside of rearward portion of the crown, to position the rearward surface of the facing panel in confronting relationship with the rearward portion of the crown and to position the crease along the lower periphery; and (b) fastening means for securing the rearward surface of the backing panel to the inside rearward portion of the cap.

2. The cap of claim 1, wherein the fabric face material is pliable and moisture absorbent.

3. The cap of claim 1, further comprising secondary radial creases in the backing panel for facilitating an arcuate bending of the backing panel conforming with the band and the head.

4. The cap of claim 1, further comprising a third backing material on the support material opposite the face material.

5. The cap of claim 4, wherein the face material, support material and backing material are adhesively laminated together.

6. The cap of claim 1, wherein the face material and the support material are adhesively laminated together.

7. The cap of claim 1, wherein the fastening means are on the rearward surface of the facing panel and the backing panel to secure the attachment to the rearward portion of the cap.

8. The cap of claim 7, wherein the fastening means are chosen from a group comprising complimentary hook and loop materials, adhesives, double-sided tapes, snaps, hooks and buttons.

9. The cap of claim 1, wherein the facing panel displays any one of the following group comprising a name, an emblem, a crest, an advertisement, an indicia, a trademark and a number.

10. The cap of claim 1, wherein the fastening means are chosen from a group comprising stitching, hook and loop materials, adhesives, double-sided tapes, snaps, hooks and buttons.

11. The cap of claim 1, wherein the facing panel may be folded downwardly to display indicia on the rearward surface of the facing panel.

12. A baseball style cap with an emblem bearing cap attachment, the cap having a crown with an inside for fitting on a human head with a lower periphery, a forward portion with a forwardly directed stiff visor extending from the lower periphery, a rearward portion and a band extending around the inside of the lower periphery of the crown, the emblem bearing cap attachment comprising:

(a) a substantial planar body having a pliable and moisture absorbent fabric face material and a relatively stiff support material secured together defining a forward surface and a rearward surface, a primary crease extending centrally across the planar body defining a facing panel for display of indicia and a backing panel respectively above and below the crease, the primary crease facilitating a folding of the body about the rearward portion of the band to position the rearward surface of the backing panel in confronting relationship with the inside of rearward portion of the crown, to position the rearward surface of the facing panel in confronting relationship with the rearward portion of the crown and to position the crease along the lower periphery; and (b) fastening means for securing the rearward surface of the backing panel to the inside rearward portion of the cap.

13. The cap of claim 12, further comprising secondary radial creases in the backing panel for facilitating an arcuate bending of the backing panel conforming with the band and the head.

14. The cap of claim 12, further comprising a third backing material on the support material opposite the face material.

15. The cap of claim 14, wherein the face material, support material and backing material are adhesively laminated together.

16. The cap of claim 12, wherein the face material and the support material are adhesively laminated together.

17. The cap of claim 12, wherein the fastening means are on the rearward surface of the facing panel and the backing panel to secure the attachment to the rearward portion of the cap.

18. The cap of claim 17, wherein the fastening means are chosen from a group comprising complimentary hook and loop materials, adhesives, double-sided tapes, snaps, hooks and buttons.

19. The cap of claim 12, wherein the facing panel displays any one of the following group comprising a name, an emblem, a crest, an advertisement, an indicia, a trademark and a number.

20. The cap of claim 12, wherein the fastening means are chosen from a group comprising stitching, hook and loop materials, adhesives, double-sided tapes, snaps, hooks and buttons.

21. The cap of claim 12, wherein the facing panel may be folded downwardly to display indicia on the rearward surface of the facing panel.

22. A baseball style cap with an emblem bearing cap attachment, the cap having a crown with an inside for fitting on a human head with a lower periphery, a forward portion with a forwardly directed stiff visor extending from the lower periphery, a rearward portion and a band extending around the inside of the lower periphery of the crown, the emblem bearing cap attachment comprising:

(a) a substantial planar body having a pliable and moisture absorbent fabric face material and a relatively stiff support material and a third backing material adhesively laminated together defining a forward surface and a rearward surface, a primary crease extending centrally across the planar body defining a facing panel for display of indicia and a backing panel respectively above and below the crease, the primary crease facilitating a folding of the body about the rearward portion of the band to position the rearward surface of the backing panel in confronting relationship with the inside of rearward portion of the crown, to position the rearward surface of the facing panel in confronting relationship with the rearward portion of the crown and to position the crease along the lower periphery;

(b) secondary radial creases in the backing panel for facilitating an arcuate bending of the backing panel conforming with the band and the head; and (c) fastening means for securing the rearward surface of the backing panel to the inside rearward portion of the cap wherein the facing panel may also be folded downwardly to display indicia on the rearward surface of the facing panel.

* * * * *